US012428918B2

(12) United States Patent
Horn et al.

(10) Patent No.: US 12,428,918 B2
(45) Date of Patent: Sep. 30, 2025

(54) OFFSHORE DRILLING APPARATUS AND METHODS

(71) Applicant: DeltaTek Oil Tools Limited, Aberdeen (GB)

(72) Inventors: Tristam Paul Horn, Westhill (GB); Stephen Edmund Bruce, Blairgowrie (GB); Tyler Rhes Reynolds, Magnolia, TX (US); David Michael Shand, Banchory (GB)

(73) Assignee: EXPRO NORTH SEA LIMITED, Aberdeen (GB)

( * ) Notice: Subject to any disclaimer, the term of this patent is extended or adjusted under 35 U.S.C. 154(b) by 0 days.

(21) Appl. No.: 18/682,260

(22) PCT Filed: Aug. 2, 2022

(86) PCT No.: PCT/GB2022/052028
§ 371 (c)(1),
(2) Date: Feb. 8, 2024

(87) PCT Pub. No.: WO2023/017242
PCT Pub. Date: Feb. 16, 2023

(65) Prior Publication Data

US 2024/0344407 A1 Oct. 17, 2024

(30) Foreign Application Priority Data

Aug. 12, 2021 (GB) ..... 2111613

(51) Int. Cl.
*E21B 17/08* (2006.01)
*E21B 17/07* (2006.01)
*E21B 19/09* (2006.01)

(52) U.S. Cl.
CPC ..... *E21B 17/085* (2013.01); *E21B 17/073* (2013.01); *E21B 19/09* (2013.01)

(58) Field of Classification Search
CPC ..... E21B 17/05; E21B 17/07; E21B 17/073
See application file for complete search history.

(56) References Cited

U.S. PATENT DOCUMENTS 3,129,774 A * 4/1964 Armstrong ..... E21B 7/128 175/7
4,452,472 A * 6/1984 Crase ..... E21B 23/02 285/3

(Continued)

FOREIGN PATENT DOCUMENTS

CA 2887769 A1 * 4/2014 ..... E21B 17/02
GB 1404775 A 9/1975
WO 2013167872 A2 11/2013

*Primary Examiner* — Aaron L Lembo
(74) *Attorney, Agent, or Firm* — Getz Balich LLC

(57) ABSTRACT

An offshore method includes providing an elongate support string for extending between a mobile offshore drilling unit and a seabed location. The string has an upper portion and a lower portion, and an articulated joint is provided between the upper portion and the lower portion. The provision of the articulated joint maintains the lower portion of the elongate support string in a substantially vertical orientation and increases the safe operating radius of the mobile offshore drilling unit or increases the speed at which the unit may transit through the sea with objects suspended via the elongate support string.

20 Claims, 8 Drawing Sheets

(56) References Cited

U.S. PATENT DOCUMENTS

| | | | | |
|---|---|---|---|---|
| 4,466,487 | A * | 8/1984 | Taylor, Jr. | E21B 7/128 166/348 |
| 5,951,061 | A | 9/1999 | Arlt, III | |
| 7,311,148 | B2 * | 12/2007 | Giroux | E21B 43/10 175/57 |
| 8,973,682 | B2 * | 3/2015 | Gosselin | E21B 37/00 175/323 |
| 10,012,044 | B2 * | 7/2018 | Leba | E21B 17/085 |
| 10,590,744 | B2 * | 3/2020 | Liess | E21B 17/03 |
| 11,015,400 | B2 * | 5/2021 | Horn | E21B 41/0007 |
| 2004/0218981 | A1 | 11/2004 | Chenin | |
| 2012/0312600 | A1 * | 12/2012 | Abbasi | E21B 7/067 464/106 |

* cited by examiner

OFFSHORE DRILLING APPARATUS AND METHODS

This application claims priority to PCT Patent Appln. No. PCT/GB2022/052028 filed Aug. 2, 2022, which claims priority to Great Britain Patent Appln. No. 2111613.2 filed Aug. 12, 2021, which are hereby incorporated herein by reference in their entireties.

BACKGROUND OF THE INVENTION

1. Technical Field

This disclosure relates to apparatus and methods for use in relation to offshore drilling operations and other offshore operations relating to offshore boreholes.

2. Background Information

Operations to access subsea rock formations, such as hydrocarbon-bearing formations, are often carried out from mobile offshore drilling units (MODUs). These units are not rigidly fixed to the seabed but may be maintained in position by anchors and tethers or a variety of dynamic positioning systems that react to, for example, wind, waves, and sea currents, to maintain the unit in a desired position. A drilling riser may extend from the unit to a wellhead assembly on the seabed and elongate support members, such as drill strings or running strings, may pass through the drilling riser. In other operations, particularly in the early stages of creating a well bore and before a drilling riser has been installed, the drill strings and the like may extend through open water.

The unit will experience a degree of movement relative the fixed borehole location on the seabed, and the operator will have determined a safe operating radius or watch circle for the unit around the borehole location. This may be related, at least in part, to the ability of the drill string or other member extending between the unit and the seabed to accommodate a safe degree of bending, and the reaction time required by the operator to take appropriate action should the unit move too far from the well. If the unit moves beyond the safe operating radius, drilling or other operations may have to be halted, or it may even be necessary to disconnect the drill string.

Movement of the unit within the safe operating radius may not compromise the safety of a subsea operation but may, for example, increase the likelihood of a drill string suffering damage from low cycle fatigue as the drill string is affected by continual bending moments or be mechanically damaged during rotation.

The unit may elect to suspend objects into the sea column beneath the unit during operations, which can restrict the speed at which the unit can move through the sea surface with a rigid deployment conduit between the unit and the suspended object. The unit may wish to move through the sea for various purposes included transit from one location to another, or for departing a hazardous incident such as a shallow gas blowout, whilst the object is suspended beneath the unit.

WO2018/042148, the disclosure of which is incorporated herein in its entirety, discloses an articulated joint which may be provided between a work string and subsea infrastructure.

U.S. Pat. No. 5,951,061 describes an elastomeric flex joint provided with a rotational bearing so that torsional stress is relieved by slip of the rotational bearing.

SUMMARY

According to a first aspect of the disclosure there is provided an offshore method comprising: providing an elongate support string for extending between a mobile offshore drilling unit and a seabed location, the string having an upper portion and a lower portion; providing an articulated joint between the upper portion and the lower portion of the elongate support string, and maintaining the lower portion of the elongate support string in a substantially vertical orientation.

A further aspect of the disclosure relates to apparatus for use in offshore drilling operations comprising: an elongate support string for extending between a mobile offshore drilling unit and a seabed location, the string having an upper portion and a lower portion, and an articulated joint between the upper portion and the lower portion of the elongate support string, whereby the articulated joint facilitates maintaining the lower portion of the elongate support string in a substantially vertical orientation.

Additional aspects of the disclosure relate to methods and apparatus for increasing the safe operating radius or watch circle diameter of a mobile offshore drilling unit by incorporating an articulated joint in an elongate support string.

When compared with operations utilizing conventional support strings, examples of the disclosure may increase the watch circle diameter to at least 10% of water depth, at least 20% of water depth, at least 30% of water depth, at least 40% of water depth, at least 50% of water depth, or at least 60% of water depth.

The provision of the articulated joint between the string portions facilitates accommodation of misalignment between the drilling unit and the seabed location while maintaining the lower portion of the support string in a substantially vertical orientation, or otherwise facilitating alignment of the lower portion of the support string with a structure or item on or below the seabed.

The provision of the articulated joint between the string portions facilitates increased speed at which the unit may transit through the sea column with the support string and objects supported by the string being suspended safely.

The elongate support string may take any appropriate form and may be, for example, a tubular string formed by multiple drill pipe sections. The drill pipe sections may be tubular and formed of an appropriate metal. The drill pipe sections may feature end connections, for example a threaded pin connection at a lower end and a threaded box connection at an upper end. The string may be a drill string and may be subject to extended periods of rotation. In other examples the string may simply provide support and may not normally be subject to rotation, or only subject to occasional rotation.

A single articulated joint may be provided in the support string, or two or more articulated joints may be provided. An upper articulated joint may facilitate maintaining a portion of the string which is coupled to the mobile offshore drilling unit in a substantially vertical orientation. One or more articulated joints may be provided intermediate the ends of the support string. One or more articulated joints may be provided at ends of the support string, for example an articulated joint may be provided at a lower or distal end of the support string.

The elongate support string may extend through open water. In other examples the support string may extend through a drilling riser or other structure.

The method may comprise supporting a tool on the support string and may further comprise maintaining the tool in a substantially vertical orientation or facilitating alignment of the tool with a structure or item on or fixed relative to the seabed. The articulated joint may be provided between the support string and the tool. The method may further comprise lowering the tool into position, for example on the seabed or onto, into or through an assembly or structure on the seabed, or into a bore hole extending below the seabed. Alternatively, or in addition, the method may further comprise pulling, lifting, or retrieving a tool from the seabed, from or through an assembly or structure on the seabed, or from or through a bore hole extending below the seabed.

The provision of the articulated joint facilitates maintaining the tool in alignment with the assembly, structure or bore hole; the tool may remain aligned with the assembly, structure or bore hole, even if the mobile offshore drilling unit moves from a position directly vertically above the assembly, or the assembly is inclined. The provision of the articulated joint may further facilitate articulation of the tool to align with the assembly, structure or bore hole; the orientation of the tool may be adjusted or varied to facilitate coupling of the tool to the assembly when there would otherwise be misalignment between the string and the assembly. This may be useful if the tool is to interact with the assembly or structure, for example to engage fasteners on the assembly to allow the tool to be secured to the assembly. Similarly, if the tool is to be translated through a bore, the ability to maintain the tool in alignment with the bore facilitates translation of the tool through the bore, particularly if the tool has an outer diameter close to the inner diameter of the bore. If the tool is to be pulled or retrieved from a bore, it is advantageous if the tension or pulling force applied to the tool by the support string is aligned with the bore axis, as applying a pulling force that is inclined to the bore access may cause the tool to tilt in the bore and engage with the bore wall.

The provision of an articulated joint may facilitate movement of the unit to avoid a hazardous situation without having to retrieve or disconnect the support string and without damaging or affecting the operation of the support string, or objects or tools coupled to or suspended from the string. For example, when drilling through sediment or other material close to the seabed it is not uncommon for gas to be released from the material, and the gas to then rise through the water. The gas may be flammable or otherwise potentially hazardous and may reduce the density of the water and the buoyancy of the unit such that there is a risk of the unit sinking. Accordingly, in such a situation it is preferable to move the drilling unit away from the drilling site, typically upstream of the site. The provision of at least one articulated joint facilitates movement of the unit while allowing the drill string to remain in the bore. The distal end of a drill string comprises a bottom hole assembly (BHA) which tends to be relatively rigid and will not withstand any significant degree of bending without suffering damage. By providing an articulated joint in the string above the BHA, and for example 0-20 meters above the seabed, it is possible for the BHA to remain substantially vertical and extending at least partially into the bore while the articulated joint accommodates the deflection of the string resulting from the movement of the drilling unit. The operator also retains the ability to pump heavy fluids into the bore through the string, to limit or control gas entry into the well bore. In a similar situation with a conventional rigid string there would be a real risk of the string bending to the extent that it was not possible to pump through the string, or the string or BHA breaking at the seabed.

The provision of the articulated joint may also be useful as a contingency when subsea infrastructure is being conventionally deployed from an offshore rig, on a support string and a storm outbreaks, the articulated joint is subsequently connected to the support string and deployed subsea to introduce articulation to what would conventionally be a rigid support string.

A further aspect of the disclosure thus relates to the provision of an articulated joint in a support string to accommodate environmental conditions, for example a deterioration in weather conditions. The articulated joint may be provided in an initial configuration and subsequently reconfigured. For example, the articulated joint may be connected to the support string in a rigid or non-articulating configuration and then reconfigured to permit articulation if environmental conditions deteriorate. The articulated joint may be reconfigured to the rigid or non-articulating configuration once environmental conditions improve, or if an operation involving the string requires a rigid string.

The provision of the articulated joint may also be useful when subsea infrastructure is itself inclined or tilted, as may occur if a bore is drilled off the vertical or as a wellhead assembly settles on the seabed. The lower portion of the support string, or a tool supported by the string, may readily tilt to accommodate the inclination or tilt.

The method may comprise supporting a bore-lining tubular, which may be a conductor, a casing or a liner, from the string. In one example a conductor, that is a relatively large diameter casing that is usually the first bore-lining tubular located in the bore, is supported on the string as the conductor is jetted into position. The jetting fluid may be supplied from surface through the support string to fluid jetting arrangements provided at the leading end of the conductor. A drill bit may be mounted on the leading end of the support string such that, on the conductor reaching target depth, for example 300 feet (91.4 meters), the conductor is released from the string and drilling of the bore beyond the end of the conductor may commence immediately. In a conventional arrangement the running string supporting the conductor would have to be retrieved to surface and a drill string then made up and run into the bore before drilling could commence. The articulated joint may be locked before drilling commences.

The articulated joint may take any appropriate form. The joint may include a flex portion or member such as a length of relatively flexible material. Alternatively, or in addition, the joint may include a ball and socket arrangement, or a universal joint.

The support string and the articulated joint may define a through bore or passage to permit the passage of tools or other items through the string, or to permit fluid to pass through the string. Seals may be provided between parts of the joint to ensure that the joint through bore is pressure tight.

The articulated joint may be arranged to transfer torque between the portions of the support string.

The articulated joint may have multiple degrees of articulation positions and may be fully lockable (rigid) to prevent or limit pivoting between the portions of the support string. In one example the articulated joint may be adjustable to control or restrict the maximum degree of pivoting or articulation between the portions of the support string or may be configurable to prevent any pivoting or articulation between the support string portions. The articulated joint may comprise an upper part for coupling to the upper string portion and a lower part for coupling to the lower string portion. The upper part may pivot relative to the lower part.

In one example the upper part comprises a part-spherical socket and the lower part comprises a ball for engaging with the socket. The socket and ball may be coupled to permit transfer of torque therebetween. A member may be provided to extend between the parts of the joint to control or limit relative pivoting of the parts. The member may comprise a sleeve or other structure which is retractable or otherwise reconfigurable to permit pivoting and extendable to restrict or prevent pivoting. In one example the degree of pivoting permitted by the sleeve is related to the position or configuration of the sleeve relative to one of the parts. For example, the sleeve may be axially movable relative to a joint body or may be rotatable relative to a joint body. In another example the sleeve may be segmented or hinged, and parts of the sleeve may be circumferentially constrained, for example by a clamp, to allow the sleeve to open and close to increase and decrease the degree of pivoting permitted. An inner surface of the sleeve may define a locking face and the locking face may include areas oriented at different angles to an axis of the joint. A cooperating locking face may be provided on one of the joint parts.

A drill string guide may be provided for use in combination with the support string and articulated joint. The guide may include a restraining member for location above the seabed for limiting the lateral movement of the support string. In use, the restraining member may be located above the articulated joint.

The drill string guide may be restrained relative to the seabed, for example by a system of anchors and tethers. Alternatively, or in addition, the guide may include thrusters or the like for maintaining the guide in a predetermined location.

Another aspect of the present disclosure relates to moving a mobile offshore drilling unit across a body of water with an elongate support member suspended from the drilling unit and extending into the water, wherein the elongate support member includes at least one articulated joint.

The provision of an articulated joint in the support member facilitates relative movement between portions of the support member, or between the support member and a tool or the like coupled to the support member. In the absence of an articulated joint movement between portions of the support member would have to be accommodated by bending of the support member, which bending may result in damage to the support member.

It will be apparent to the skilled person that the different aspects of the disclosure described above, the various optional features of those aspects, and the features identified in the claims below, may be combined as appropriate. Further, the various optional features may have utility independently of the related aspects. An articulated joint having the ability to adjust the maximum degree of pivoting available will have individual utility, as will a drill string guide having the ability to limit lateral movement of a drill string or other support member.

BRIEF DESCRIPTION OF THE DRAWINGS

These and other examples of aspects of the disclosure, will now be described, by way of example, with reference to the accompanying drawings, in which.

DETAILED DESCRIPTION

Figure 1:
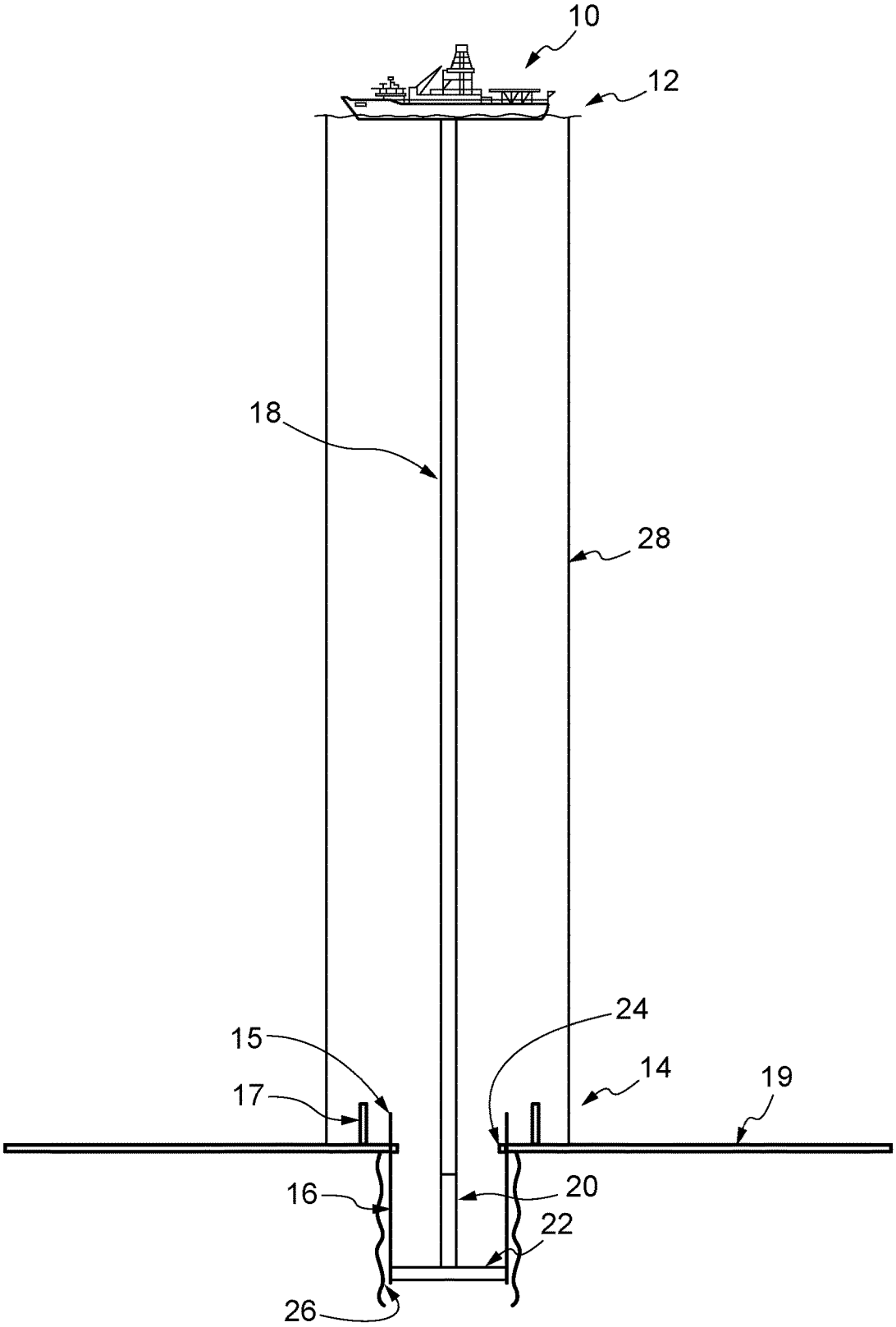
FIG. 1 is an illustration of a subsea drilling operation for installation of a conductor or surface casing.

Reference is first made to FIG. 1 of the drawings, an illustration of a subsea drilling operation for installation of a conductor or surface casing. Drilling operations are conducted from a mobile offshore drilling unit 10 floating on the sea surface 12, and a wellhead assembly 14 has been positioned on the seabed. The assembly 14 includes a wellhead housing 15 and a guide base 17 which extend from the seabed or mudline 19. The figure illustrates an initial drilling stage, before installation of a drilling riser, and following installation and cementing of the conductor 16, the first section of bore-lining tubing/casing.

A drill string 18 extends from the drilling unit 10 through open water and into the conductor 16. A bottom hole assembly (BHA) 20 is mounted on the lower end of the string 18 and is provided with a drill bit 22. A bushing 24 is provided in the wellhead assembly 14 to prevent wear or damage from contact between the rotating drill string 18 and the assembly 14.

The drill bit 22 will drill out of the conductor shoe and beyond the lower end of the conductor 16 to extend the bore 26 and allow installation of a further casing string (not shown) to line the newly drilled bore section. The casing will extend from the wellhead assembly 14 to the end of the newly drilled bore section.

During a drilling operation the drilling unit 10 will experience dynamic forces from, for example, waves, wind, heave, and sea currents. The unit 10 will be provided with systems which operate to maintain the unit 10 directly above the bore 26, but it is inevitable that some movement of the unit 10 will occur, particularly in severe weather. The drilling apparatus will tolerate a degree of movement of the drilling unit 10 away from direct vertical alignment with the bore 26, and this safe operating radius 28 is sometimes referred to as the watch circle. If the unit 10 approaches or moves beyond the safe operating radius 28 operations may have to be stopped, and in extreme situations the drill string 18 may have to be disconnected. Also, even when the drilling unit 10 remains within the watch circle 28 the drill string 18 may experience bending and if the drill string 18 is rotating this may result in metal fatigue damage to the string 18, thus shortening the safe working life of the drill string components.

Figure 2:
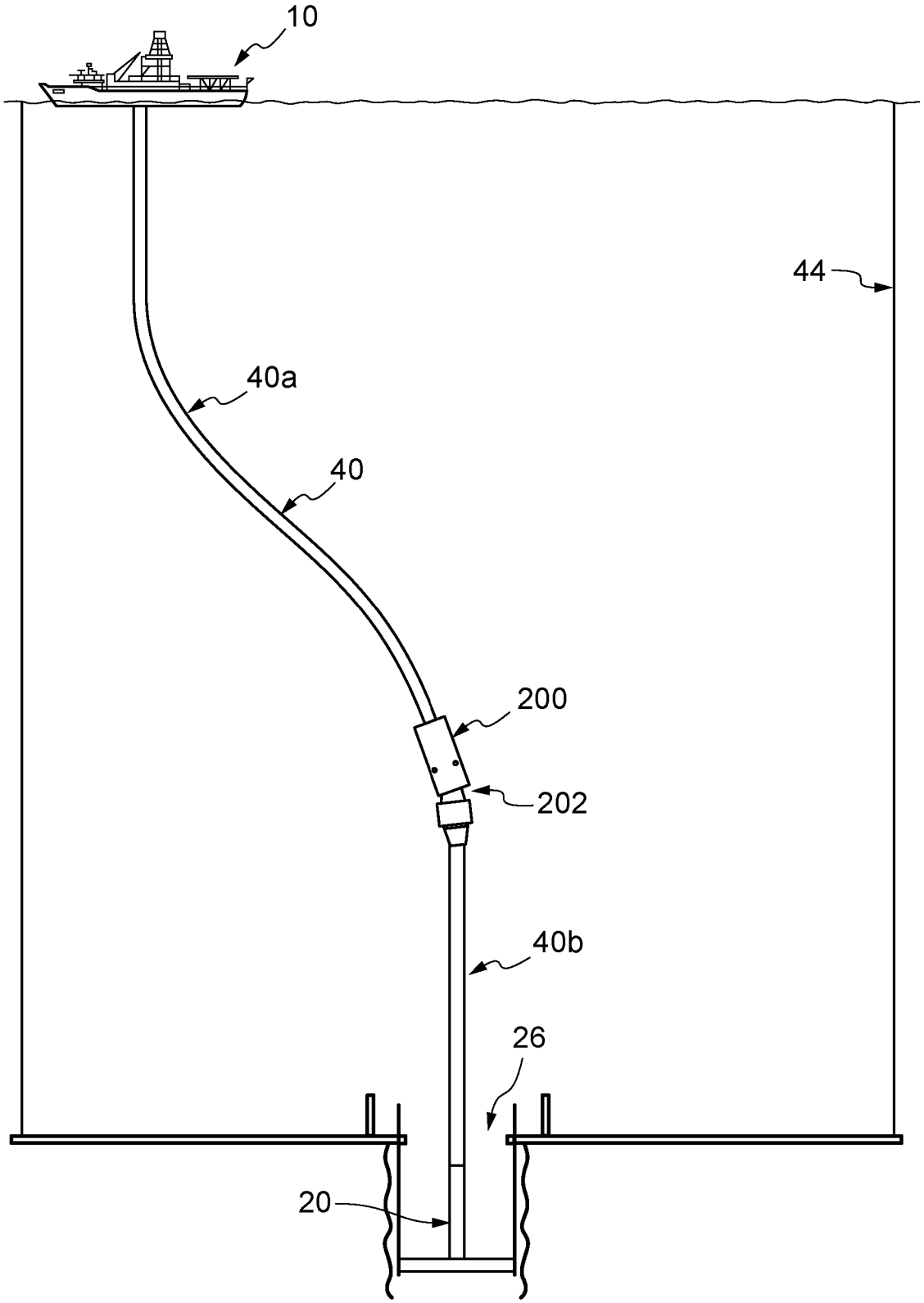
FIG. 2 shows a subsea drilling operation in accordance with an example of the present disclosure.
Figure 3:
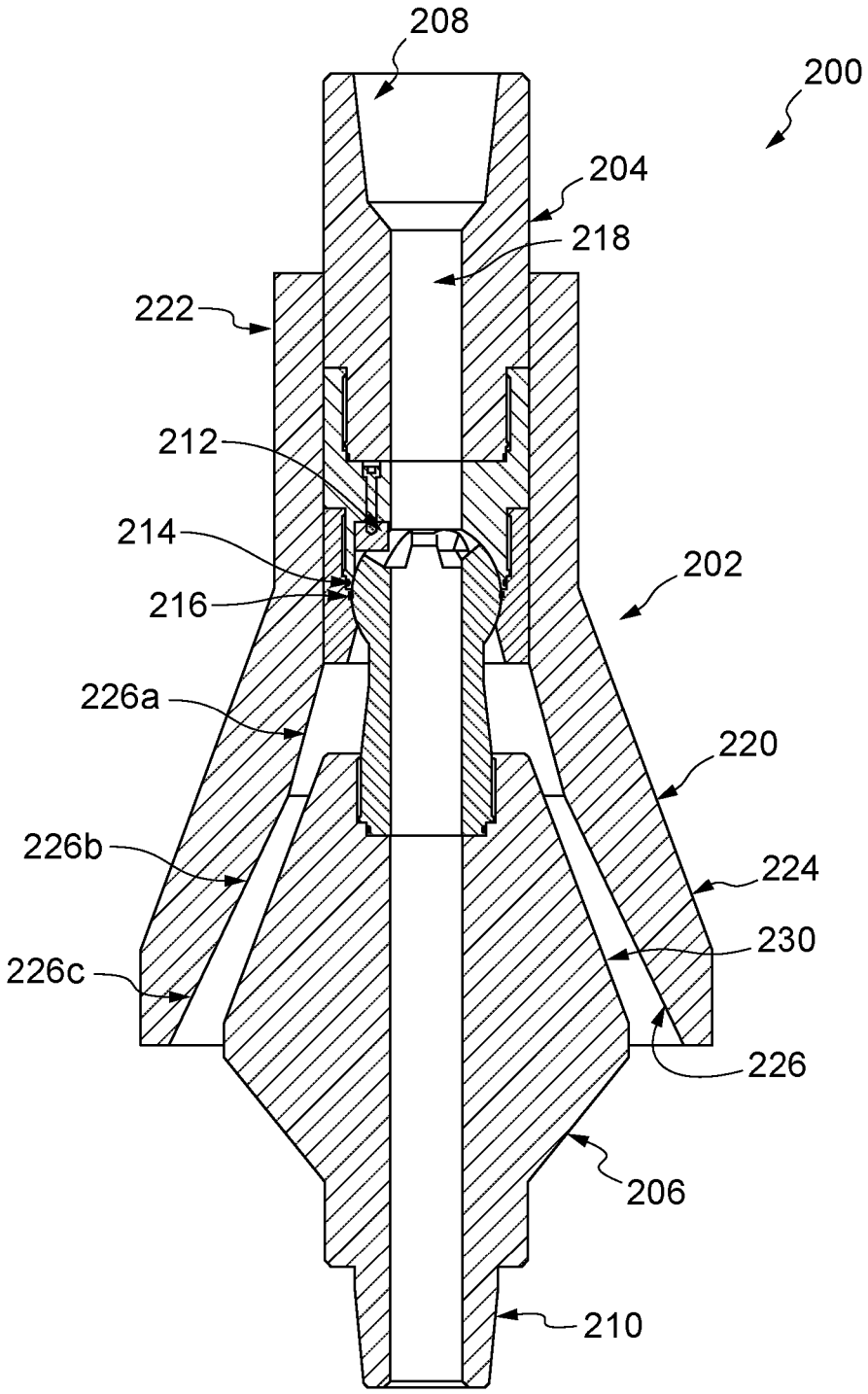
FIG. 3 is a sectional view of an articulated joint used in the drilling operation of FIG. 2.

Reference is now made to FIG. 2 of the drawings, a subsea drilling operation in accordance with an example of the present disclosure, and to FIG. 3 of the drawings, a sectional view of an articulated joint for use in the drilling operation of FIG. 2. The apparatus used in the operation of FIG. 2 is similar in many respects to the apparatus illustrated in FIG. 1 however the apparatus of FIG. 2 includes a modified drill string 40 comprising an upper section 40*a* and a lower section 40*b* joined by an articulated joint 200, as shown in greater detail in FIG. 3. The joint 200 includes a ball and socket arrangement 202 and is capable of transmitting torque. The joint 200 is described in greater detail below. A conventional drill string 18, as illustrated in FIG. 1, is relatively rigid and will only tolerate limited bending. However, the provision of the joint 200 in the string 40 allows the upper and lower drill string sections 40*a*, 40*b* to pivot relative to one another. This facility for pivoting between the sections 40*a*, 40*b* allows the string 40 to accommodate a greater degree of misalignment between the drilling unit 10 and the bore 26 and facilitates retaining the lower drill string section 40*b* in a substantially vertical orientation. This facilitates the drilling of a vertical bore.

The BHA 20 may incorporate drill collars, relatively stiff and heavy tubular sections, and other heavy components, which maintain the lower section 40*b* in tension. This provides a pendulum effect which tends to maintain the lower section 40*b* in a vertical orientation.

In the absence of the joint 200, movement of the mobile drilling unit 10 from a position vertically above the bore 26 is accommodated by bending of the drill string. As noted above a conventional drill string will only accommodate a limited degree of bending and that bending tends to be concentrated in the uppermost and lowermost sections of the string, limiting the degree of movement of the unit 10 that may be accommodated safely. However, by providing the articulated joint 200 in the string 40 the bending of the string 40 necessary to accommodate movement of the unit 10 is significantly reduced, with the result that the safe operating radius 44 is significantly increased.

The skilled person will appreciate that this would be particularly beneficial in severe weather conditions, for example high winds and a sea-state that would affect the position of the drill-rig, by increasing the work circle (watch circle) of the drilling unit 10, thus reducing weather downtime and generally improving well construction efficiency.

The safe operating radius/diameter or watch circle of a conventional offshore operation with a riser attached to the wellhead is typically calculated from a number of weather and sea-state related conditions and rig, riser and well structure capacities, including, lower and upper flexible joint allowable flex, the telescopic joint opening and closing stroke length and the allowable bending moments of the wellhead system including the structural casing. The resultant calculations provide a radius/diameter and is often expressed as a percentage or proportion of water depth. For example, current high specification rigs may operate with a watch circle diameter of 10% water depth, while less sophisticated rigs may operate with a watch circle of 7.5%.

The safe operating radius/diameter or watch circle of a conventional offshore operation where a riser is not used, that is in through water operations is typically calculated from a number of weather and sea-state related conditions. Examples of the present disclosure allow the watch circle diameter to be increased significantly, for example to 54% of water depth. Thus, while an operation undertaken with a conventional string in 5000 feet (1524 m) of water from a higher specification rig may have a 10% water depth watch circle diameter of 500 feet (152 m), provision of an articulated joint may increase the watch circle diameter to 2679 feet (817 m). Accordingly, it is likely that there will be far fewer interruptions to operations due to movement of the unit 10 than would be the case with a conventional support string.

The illustrated joint 200 comprises upper and lower tubular parts 204, 206, the upper part 204 including an internally threaded box connection 208 for engaging with a pin connection at the lower end of the upper drill string section 40*a* and the lower part 206 including an externally threaded pin connection 210 for engaging with a box connection at the upper end of the lower drill string section 40*b*. The ball and socket arrangement 202 comprises a part-spherical socket 212 provided at the lower end of the upper part 204 for receiving and retaining a ball 214 provided at the upper end of the lower part 206. A seal 216 is provided on the ball 214 to provide a sliding sealing contact with the socket 212 and maintain the joint through bore 218 fluid tight. The ball 214 and socket 212 are keyed together to permit the transmission of torque through the joint 200.

The joint 200 is provided with a locking arrangement in the form of a sleeve 220 which, in a fully retracted position, allows relatively unrestricted pivoting, and in a fully extended position locks the joint 200 with the upper and lower parts 204, 206 in axial alignment. The sleeve 220 of the illustrated joint may also be fixed in intermediate positions to provide three different maximum pivot angles, as will be described. The sleeve 220 has an upper portion 222 having an inner diameter slightly bigger than the outer diameter of the joint upper part 204 to permit the sleeve 220 to slide axially over the upper part 204. The sleeve 220 has a flared lower portion 224 including an inner surface 226 defining three different locking face angles 226*a*, 226*b*, 226*c*.

The sleeve 220 is moved relative to the joint parts 204, 206 by any appropriate means, for example by a set of hydraulic cylinders. In other examples the sleeve may be adapted to be moved by an ROV: the sleeve may be mounted on a lazy j-slot and the ROV rotates the sleeve to adjust and lock the sleeve and set the degree of articulation; the sleeve may be mounted to the joint body on a large square thread such that an ROV may rotate the sleeve to a desired position, or the sleeve may be lifted and locked by an ROV. To facilitate ROV movement the sleeve may be coupled to sub-sea buoyancy material to render the sleeve neutrally buoyant.

The lower joint part 206 may have a profile adapted to cooperate with the sleeve inner surface 226 and in the illustrated example the part 206 has a truncated conical form 230.

The joint 220 is illustrated in FIG. 3 with the sleeve 220 in an intermediate position, and the lower joint part 206 may rotate or pivot relative to the upper part (by up to 7.5° from the axial position, to provide a total maximum articulation of 15°) until the conical outer surface 230 comes into contact with the intermediate locking face angle 226*b*. The angle of rotation permitted may be increased by retracting or raising the sleeve 220 and decreased by extending or lowering the sleeve 220. If the sleeve 220 is fully extended to bring the shallowest locking face angle 226*a* into contact with the surface 230 the joint 200 is locked and does not permit any pivoting. In this example fully retracting the sleeve 220 permits pivoting of 15° from the axial to permit a total articulation of 30°.

The degree of rotation or pivoting permitted by the joint 220 may be related to the dimensions of the tools and other items that are to be passed through the string 40. For example, longer or larger diameter tools may not be able to pass through the joint 220 if the upper and lower joint parts 204, 206 are at an angle which significantly restricts the joint through bore 218. In such a situation the operator will set the sleeve 220 to permit a maximum degree of relative rotation that still permits clear passage of the tool through the joint 200. By way of example, a 4-inch (10.16 cm) diameter bore 218 may be provided in the joint 200. In the locked configuration, in which no pivoting is permitted, larger (+3 inch (7.2 cm)) electric wireline tools on hepta-cable may pass easily through the joint 200. However, if smaller diameter tools are to be deployed through the joint 200, for example small (1 11/16" (4.2863 cm)) electric line tools on monocable or slickline, the joint 200 may be reconfigured to permit a degree of pivoting, limited by contact between the conical surface 230 and the intermediate locking face angle 226*b*. Further, if the joint 200 is only providing passage for fluids, for example injection of pressured fluids at high rates for well-killing or workover operations, then the maximum degree of pivoting provided by the lower locking face angle 226*c* may be employed.

The skilled person will appreciate that the illustrated articulated joint 200 is only one example of a joint that could be employed in the drilling operation. In other examples, the joint may be provided without a locking or adjusting sleeve, and the articulation between the parts of the joint may be provided by means other than a ball and socket arrangement, for example by means of length of flexible tubing supported by a universal joint. Other examples may utilize the joint forms as described in WO2018/042148, the disclosure of which is incorporated herein in its entirety.

Figure 4:
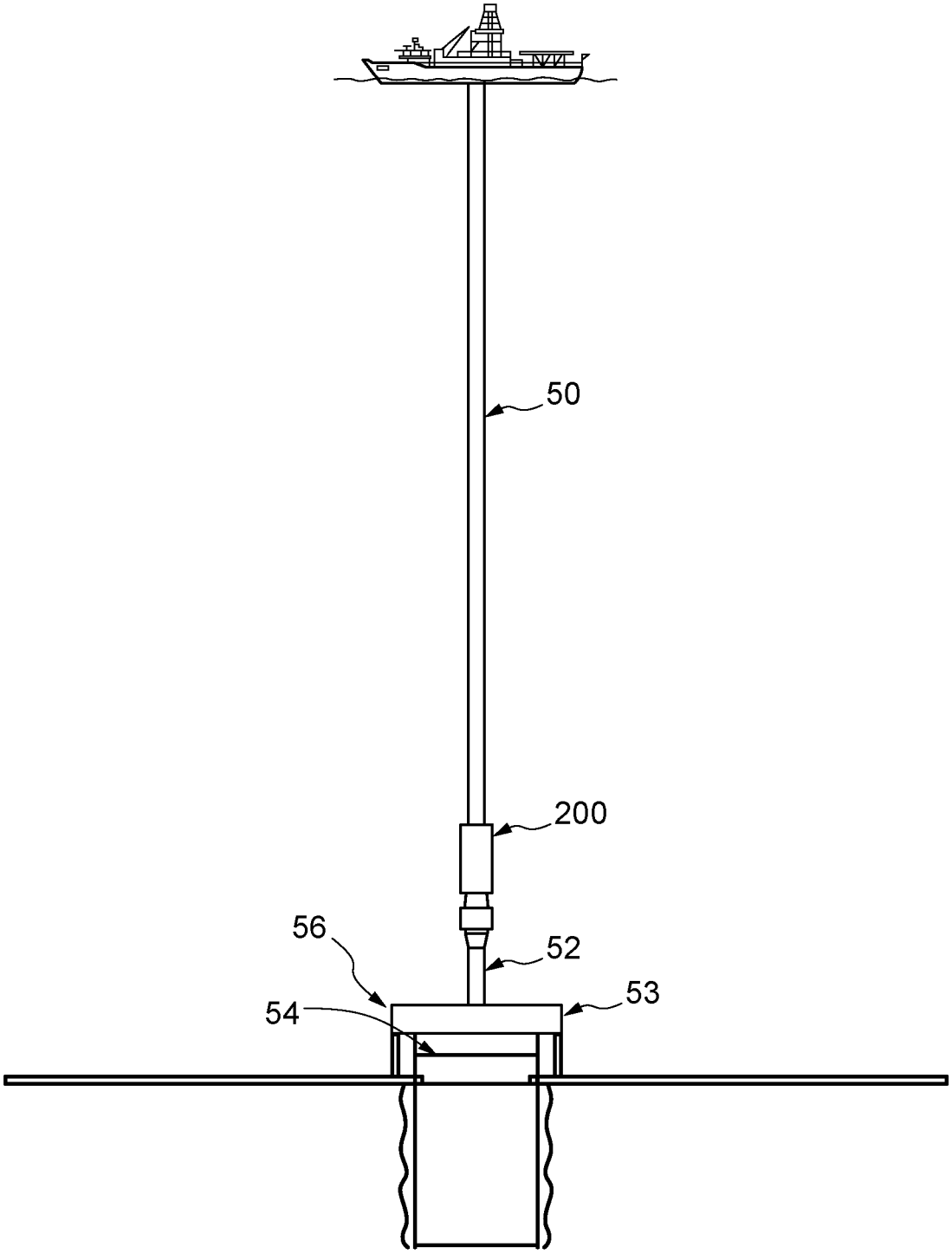
FIG. 4 shows a tree-cap or plug-pulling operation in accordance with an example of the present disclosure.

Reference is now made to FIG. 4 of the drawings, a tree-cap or plug-pulling operation in accordance with an example of the present disclosure. In this example a drill pipe string 50 is provided with a tree-cap or plug-pulling tool 52 which is to be aligned with and then engaged with a tree-cap 53 or plug 54 to be removed from a wellhead production assembly 56 so that the operator may then gain entry to the well. The following description refers primarily to the removal of the plug 54 but applies equally to the removal of the cap 53 (the cap 53 would be removed first, using an appropriate cap-pulling tool, and retrieved to the surface before removing the plug 54 using an appropriate plug-pulling tool 52). An articulated joint 200 is provided between the string 50 and the tool 52 and facilitates alignment of the tool 52 with the plug 54, which in turn facilitates engagement of the tool 52 with the plug 54. Engagement of the tool 52 with the plug 54 may be achieved by lowering the tool 52 into engagement of the plug 54, which operation may be assisted by an ROV.

Following engagement of the tool 52 with the plug 54, the provision of the articulated joint 200 will assist in maintaining the tool 52 substantially vertical to counteract any lateral movement of drill pipe string 50 related to movement of unit 10 and thus facilitate removal of the plug 54; the plug 54 will be a close fit in the wellhead production assembly 56 such that any inclination of the tool 52 would result in tilting of the plug 54 in the assembly 56, making it more difficult to remove the plug 54.

In other examples multiple plugs may be provided in the assembly 56 and require removal. Further, one of the cap or plugs may be retrieved using a drill pipe string, and wireline may be used to retrieve the other of the cap or plugs.

FIG. 4 illustrates the drilling unit 10 directly vertically above the well, however any displacement of the unit 10 due to wind or sea currents would move the drill pipe string 50 off the vertical and in the absence of the articulated joint 200 this misalignment would impact on the alignment of the tool 52 with the plug 54 or the wellhead assembly 56. The provision of the articulated joint 200 may also facilitate alignment and coupling the tool 52 with a wellhead assembly, or a component in or on the assembly, that is itself inclined, which may be the case if the bore has been drilled off the vertical or the seabed below the assembly has been subject to subsidence.

Figure 5:
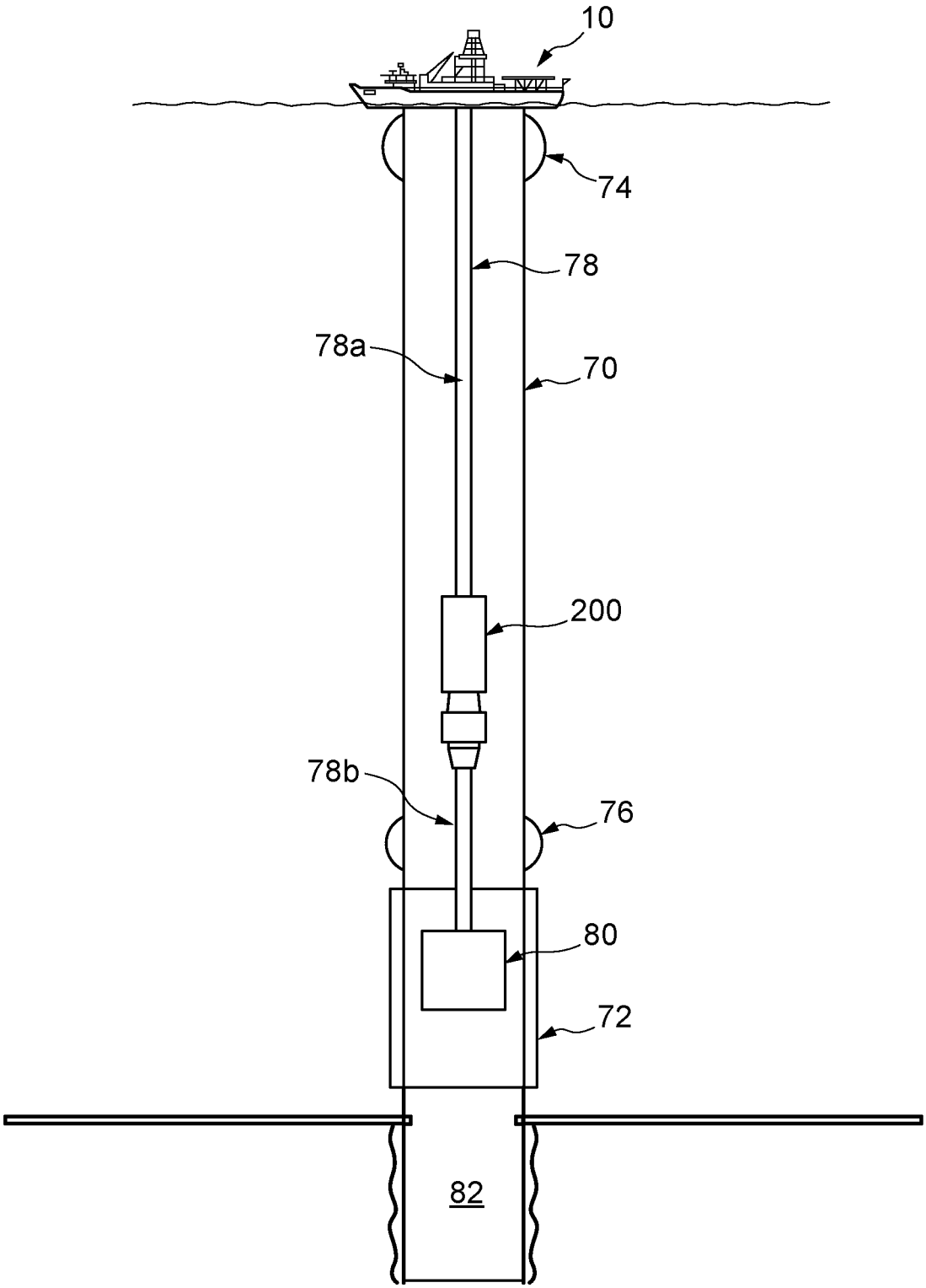
FIG. 5 shows apparatus located in a well through a drilling riser in accordance with an example of the present disclosure.

Reference is now made to FIG. 5 of the drawings, showing apparatus being positioned in a well through a drilling riser in accordance with an example of the present disclosure. In this drawing a drilling riser 70 has been installed between the drilling unit 10 and a blow-out preventer stack (BOP) 72. At this stage, the well will likely include intermediate or reservoir casings. The upper end of the riser 70 is coupled to the drilling unit 10 via a pivot/ball connection 74 and the lower end of the riser 70 is coupled to the BOP/wellhead assembly 72 via a further pivot/ball connection 76.

A drill pipe string 78 is being used to run a large diameter tool 80, which may be a plug, packer, or the like, into the well. The tool 80 has an outer diameter only slightly smaller than the inner diameter of the well bore 82 and thus must be substantially vertically aligned with the bore 82 for movement into and through the bore 82. Achieving such vertical alignment is facilitated by provision of an articulated joint 200 between upper and lower string sections 78*a*, 78*b*, allowing movement of the lower string section 78*b* and the tool 80 to align with the well bore 82 in the event of displacement of the drilling unit 10.

Figure 6:
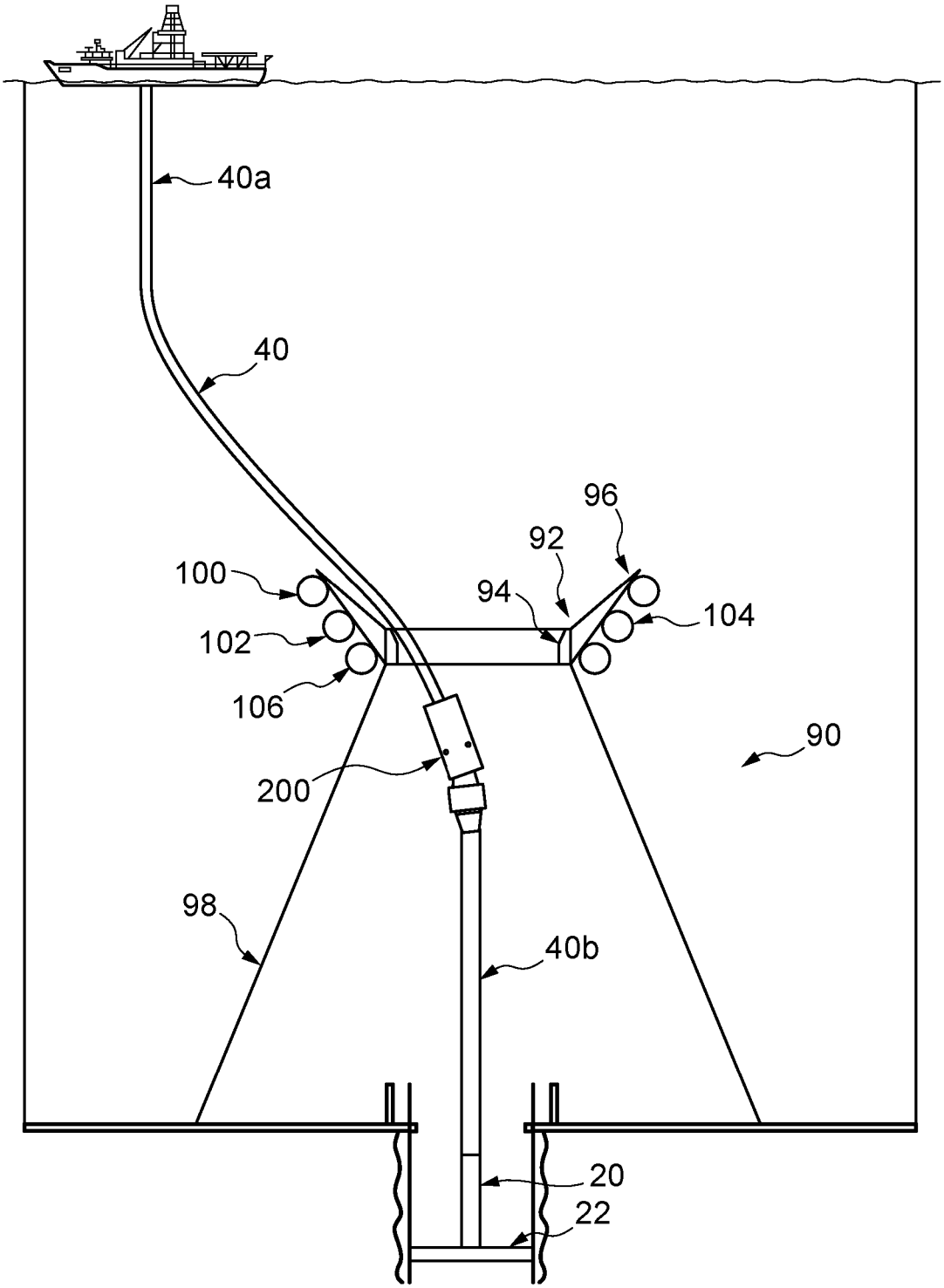
FIG. 6 shows a subsea drilling operation utilizing a drill string guide in accordance with an example of the present disclosure.

Reference is now made to FIG. 6 of the drawings, a subsea drilling operation utilizing a drill string guide in accordance with an example of the present disclosure. The drill string configuration is like that described above with reference FIG. 2, but additionally incorporates a drill string guide 90. The drill string guide 90 limits transverse movement of the drill string 40 and assists in maintaining the lower portion of the drill string 40*b* substantially vertical.

The guide 90 comprises a guide ring 92 provided with a wear bushing 94 to prevent wear between the drill string 40 and the guide 90 during running drill pipe into the well or rotating the drill string to deepen the well. A guide funnel 96 assists in guiding the drill bit 22 and BHA 20 into and through the ring 92 when the drill string 40 is being lowered towards the sea floor. The ring 92 may be provided at any convenient vertical location but is conveniently located such that when drilling commences the ring 92 is positioned above the articulated joint 200. Thus, the ring 92 limits horizontal movement of a lower end of the upper string portion 40*a*.

The guide ring 92 is buoyant and is tethered to the seabed by anchor lines 98. Further, the drill-string guide 90 is aquadynamic in form to minimize the effects of sub-sea currents on the guide 90.

The guide 90 includes both solid and fluid buoyancy systems 100, 102. The fluid buoyancy system includes a fluid-filled tank 104 which may be flooded to facilitate sinking the guide 90 into buoyed position where the guide 90 is then tethered. The tank 104 may then be emptied of sea water by gaseous displacement via an installed nitrogen system.

The tethering system may be sufficient to maintain the location of the guide 90 but in some examples thrusters 106 may be provided to assist the guide staying in the desired position. The thrusters 106 may be powered by the current flowing past the guide 90, by batteries and generators using energy generated by passing current or waves or may operate in conjunction with remote operated vehicles which are coupled to the guide 90.

Figure 7:
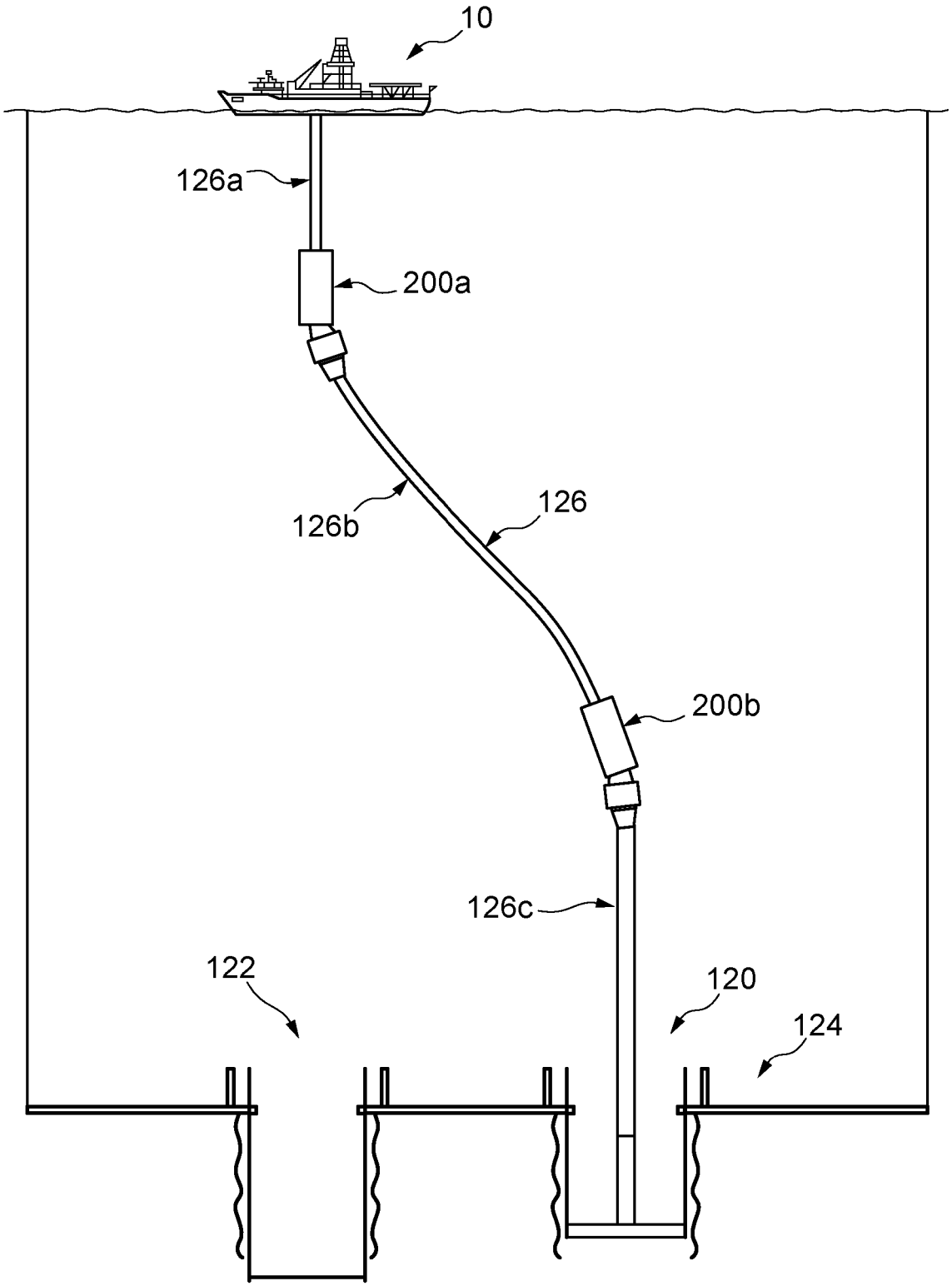
FIG. 7 shows a multiple well arrangement utilizing a drill string provided with two articulated joints in accordance with an example of the present disclosure.

Reference is now made to FIG. 7 of the drawings, showing a multiple well arrangement utilizing a drill string provided with two articulated joints in accordance with an example of the present disclosure.

The Figure illustrates a development drilling set-up where multiple wells 120, 122 are located together and housed on a wellhead template 124. In other examples the mobile drilling unit 10 may travel between two well locations. The drill string 126 includes two articulated joints 200*a*, 200*b* separating upper, intermediate, and lower drill string portions 126*a*, 126*b*, 126*c*.

In addition to facilitating a drilling operation by maintaining the lower drill string portion 126*c* substantially vertical, the articulated joints 200*a*, 200*b* allows for the drilling unit 10 to move with the drill-string 126 pulled out of the well and suspended from the unit 10 whilst the unit 10 moves from one well location to the next.

In addition, in twin derrick drilling rigs (MODU), the provision of articulated joints 200*a*, 200*b* allows for the drilling unit 10 to move with the drill-string 126, or a casing string or the like, suspended from the unit 10 whilst the unit 10 moves from one well location to the next. Thus, while an operation is being conducted on a first well using a first drilling derrick, a drill string or casing string may be at least partially made up using the second derrick and suspended below the rig. Once the operation on the first well has been completed the drill string supported by the first derrick may be partially retrieved such that the drill bit is lifted clear of any structure on the seabed. The rig may then be moved, with the first and second strings extending into the water below the rig, to position the second derrick above the second well.

The flexibility provided by the joints 200*a*, 200*b* largely eliminates low-cycle fatigue and relieves stress in the drill string 126 that would otherwise be induced through the movement of the unit 10.

Reference is made herein primarily to operations conducted from mobile offshore drilling units (MODUs), or other units, rigs or vessels that may be subject to movement. However, the skilled person will appreciate that the disclosure is relevant to operations conducted from other vessels and rigs, even those that are fixed, for example fixed rigs provided in water that experiences tidal or other sea currents that would induce bending in a support string.

Figure 8:
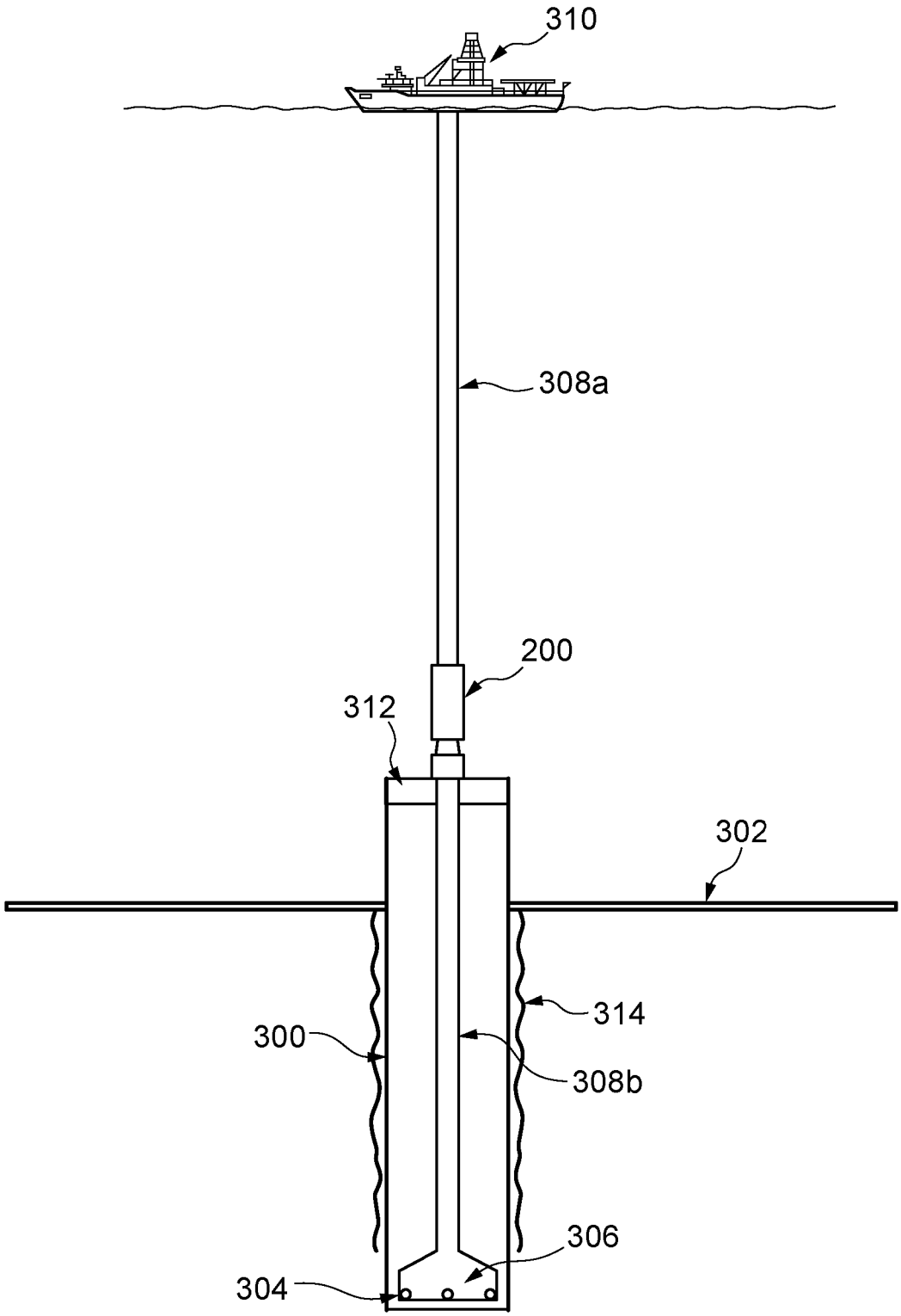
FIG. 8 shows a conductor jetting operation in accordance with an example of the present disclosure.

Reference is now made to FIG. 8 of the drawings, showing a conductor jetting operation in accordance with an example of the present disclosure. In this example a conductor 300 is being located in the seabed 302 by jetting; where the seabed 302 includes a layer of loose material, such as river-borne silt or sediment, this material may be displaced by a fluid jetting arrangement 304 provided at the leading end of the conductor 300, which may have a diameter of, for example, 20 or 30 inches (50.8 to 76.2 cm).

The jetting arrangement 304 is provided in a drill bit 306 mounted on the distal or lower end of a support string comprising a drill string 308. An articulated joint 200 is provided in the drill string 308. An upper portion of the drill string 308*a* extends down through the water to the joint 200 from a mobile offshore drilling unit 310. A lower portion of the drill string 308*b* extends downward from the joint 200 and is releasably coupled to an upper end of the conductor 300 by a running tool 312, such as the Cam-Actuated Drill Ahead (CADA) tool supplied by Dril-Quip, Inc. of Houston, Texas. The lower portion of the drill string 308*b* further extends through the conductor 300 to the drill bit 306 at the lower end of the conductor 300.

In use, the conductor 300 is supported from the drilling unit 310 by the drill string 308 and lowered to the seabed 302. Fluid is then pumped down the drill string 308 and exits through the jetting arrangement 304, displacing the loose material ahead of the leading end of the conductor 300 and forming a bore 314. The conductor 300 may thus be advanced into the bore 314 as it is formed in the seabed 302. The articulated joint 200 assists in maintaining the conductor 300 vertical as the conductor 300 is advanced into the loose material.

Once the conductor 300 has been advanced to the desired depth, the running tool 312 is disengaged from the upper end of the conductor 300. The drill string 308 may then be rotated and the drill bit 306 used to advance the bore 314 beyond the end of the conductor 300. Thus, the drilling of the bore 314 beyond the end of the conductor 300 may be commenced immediately the conductor 300 is in place. If desired, the joint 200 may be locked before drilling commences.

In other examples, additional articulated joints could be provided in elsewhere in the drill string 308 and could be locked or permitted to pivot, as desired.

The skilled person will recognize that the provision of an articulated joint in a support string may be very useful to an operator. Where the support string is located within a riser, the provision of a joint facilitates the alignment of tools and the like mounted on the string with assemblies, caps, plugs and the like. The joint may accommodate misalignment that would otherwise arise due to movement of the riser from the vertical, or where subsea infrastructure is itself misaligned from the vertical. Where the support string extends through open water the provision of one or more joints may also serve to increase the watch circle diameter that would otherwise be available and facilitates the correct alignment of conductors being jetted into the seabed and the alignment of casings and the like being deployed into drilled bores.

The skilled person will recognize that an articulated joint which may be configured to provide a controlled degree of articulation or may be adjusted or configured to provide different degrees of articulation, may have utility independently of the applications described herein.

The skilled person will further recognize that the apparatus and methods described herein may have utility in operations in addition to those where it is desired to maintain a lower portion of a support string or a tool mounted on a support string in a substantially vertical orientation, for example in extending the watch circle diameter of an offshore operation or in permitting deployment of a support string during adverse weather or during movement of a mobile drilling unit across a body of water.

The invention claimed is:

1. An offshore method comprising:

providing an elongate support string for extending between a mobile offshore drilling unit and a seabed location, the string having an upper portion formed of first drill pipe sections and a lower portion formed of second drill pipe sections;

providing an articulated joint arranged to allow the first drill pipe sections forming the upper portion and the second drill pipe sections forming the lower portion to pivot relative to one another and to transfer torque between the upper portion and the lower portion of the elongate support string;

providing a tool for creating a bore hole on the lower portion of the elongate support string, the tool comprising at least one of a drill bit and a jetting arrangement;

rotating and applying torque to the upper portion of the elongate support string and transferring torque through the articulated joint between the upper portion and lower portion of the elongate support string while allowing the second drill pipe sections forming the lower portion to pivot relative to the first drill pipe sections forming the upper portion, and maintaining the lower portion of the elongate support string in a substantially vertical orientation; and creating the bore hole that is substantially vertical and extends below the seabed.

2. The method of claim 1, wherein the elongate support string extends through open water and through a drilling riser or other structure.

3. The method of claim 1, further comprising:

supporting the tool on the support string; and providing the articulated joint between the support string and the tool.

4. The method of claim 3, further comprising at least one of: lowering the tool onto the seabed, onto, into or through an assembly or structure on the seabed, or into the bore hole extending below the seabed.

5. The method of claim 3, further comprising pulling, lifting, or retrieving the tool from the seabed, from or through an assembly or structure on the seabed, or from or through the bore hole extending below the seabed.

6. The method of claim 1, further comprising providing a through bore in the elongate support string and the articulated joint and passing the tool or fluid through the elongate support string and the articulated joint.

7. The method of claim 1, further comprising moving the mobile offshore drilling unit across a body of water with the elongate support string suspended from the mobile offshore drilling unit.

8. The method of claim 1, further comprising supporting a conductor on the elongate support string, optionally jetting the supported conductor through the seabed to target depth, and further optionally providing the drill bit on the elongate support string and drilling a bore beyond an end of the conductor.

9. The method of claim 1, further comprising providing the articulated joint in a first configuration permitting articulation and providing the articulated joint in a second configuration restricting articulation.

10. The method of claim 1, comprising configuring the articulated joint to restrict a maximum degree of articulation available between the upper portion and the lower portion of the elongate support string.

11. The offshore method of claim 1, comprising:

releasably mounting a bore-lining tubular on the lower portion of the elongate support string;

wherein the bore hole on the lower portion of the elongate support string is configured to accommodate the bore-lining tubular, and the step of rotating and applying torque is performed while maintaining the lower portion of the elongate support string and the bore-lining tubular in the substantially vertical orientation; and releasing the bore-lining tubular from the lower portion of the elongate support string whereby the bore-lining tubular is accommodated in the bore hole in a substantially vertical orientation.

12. An apparatus for use in offshore drilling operations comprising:

an elongate support string for extending between a mobile offshore drilling unit and a seabed location, the string comprising a tubular drill string formed of multiple drill pipe sections, wherein the drill pipe sections includes first drill pipe sections and second drill pipe sections, and wherein the string has an upper portion formed of the first drill pipe sections and a lower portion formed of the second drill pipe sections, and with a bore-forming assembly mounted on a lower end of the lower portion;

an articulated joint arranged to allow the first drill pipe sections forming the upper portion and the second drill pipe sections forming the lower portion of the elongate support string to pivot relative to one another and to allow a transfer of torque between the first drill pipe sections forming the upper portion and the second drill pipe sections forming the lower portion of the elongate support string; and a tool for creating a bore hole mounted on the lower portion of the elongate support string, the tool comprising at least one of a drill bit and a jetting arrangement;

whereby the articulated joint facilitates maintaining the lower portion of the elongate support string in a substantially vertical orientation while transferring rotation and torque from the first drill pipe sections forming the upper portion of the elongate support string to the second drill pipe sections forming the lower portion of the elongate support string and creating the bore hole that is substantially vertical and extends below the seabed.

13. The apparatus of claim 12, comprising at least two articulated joints.

14. The apparatus of claim 12, wherein at least one articulated joint is provided at an end of the elongate support string.

15. The apparatus of claim 12, wherein the elongate support string and the articulated joint define a through bore to permit a passage of tools or fluid.

16. The apparatus of claim 12, wherein the articulated joint is adjustable to restrict a maximum degree of articulation between the upper portion and the lower portion of the elongate support string.

17. The apparatus of claim 12, wherein the articulated joint is configurable to prevent any pivoting or articulation between the elongate support string upper portion and lower portion.

18. The apparatus of claim 12, wherein the articulated joint comprises a sleeve locatable on the joint to restrict articulation of the joint;

wherein a degree of articulation permitted by the sleeve is related to a position or configuration of the sleeve; and wherein an inner surface of the sleeve defines a locking face, and the locking face includes areas oriented at different angles to an axis of the joint.

19. The apparatus of claim 12, further comprising a drill string guide including a restraining member for location above the seabed for limiting a lateral movement of the elongate support string.

20. An apparatus for use in offshore drilling operations comprising:

an elongate support string for extending between a mobile offshore drilling unit and a seabed location, the string comprising a tubular drill string formed of multiple drill pipe sections and having an upper portion and a lower portion, and with a bore-forming assembly mounted on a lower end of the lower portion;

an articulated joint arranged to allow the upper portion and the lower portion of the elongate support string to pivot relative to one another and to allow a transfer of torque between the upper portion and the lower portion of the elongate support string;

a bore-lining tubular releasably mounted on the lower portion of the elongate support string; and a tool for creating a bore hole to accommodate the bore-lining tubular, the tool being mounted on the lower portion of the elongate support string, and the tool comprising at least one of a drill bit and a jetting arrangement;

whereby the articulated joint facilitates maintaining the lower portion of the elongate support string and the bore-lining tubular in a substantially vertical orientation while transferring rotation and torque from the upper portion of the elongate support string to the lower portion of the elongate support string and creating the bore hole that is substantially vertical and extends below the seabed to accommodate the bore-lining tubular in the substantially vertical orientation on release of the bore-lining tubular from the lower portion of the elongate support string.

* * * * *